US006168290B1

(12) United States Patent
Christiansen

(10) Patent No.: US 6,168,290 B1
(45) Date of Patent: Jan. 2, 2001

(54) GARDEN LAMP

(76) Inventor: Carl Christiansen, 769 Old York Road, Burlington, Ontario (CA), L7P 4X8

( * ) Notice: Under 35 U.S.C. 154(b), the term of this patent shall be extended for 0 days.

(21) Appl. No.: 09/318,762

(22) Filed: May 26, 1999

(51) Int. Cl.[7] ..... F21V 33/00

(52) U.S. Cl. ..... 362/253; 362/364; 362/431; 362/805

(58) Field of Search ..... 362/805, 153.1, 362/364, 431, 253

(56) References Cited

U.S. PATENT DOCUMENTS 4,716,508 * 12/1987 Kramer et al. ..... 362/431

* cited by examiner

*Primary Examiner*—Sandra O'Shea
*Assistant Examiner*—John Anthony Ward
(74) *Attorney, Agent, or Firm*—Edward H. Oldham

(57) ABSTRACT

An outdoor lighting device composed of suitable natural rock wherein the rock itself provides a suitable housing for a light source, and the rock is also used to function as a reflector-diffuser to provide a "soft" light for illuminating outdoor gardens, etc.

10 Claims, 3 Drawing Sheets

GARDEN LAMP

BACKGROUND OF THE INVENTION

The present invention relates to an outdoor lighting device suitable for use on pathways, gardens and patios etc. Prior art outdoor lighting devices which are used for lighting gardens etc. are generally of a vertical configuration where a lighting device is integrally mounted on a metal post or spike so that the spike may be driven into the ground so as to provide the stabilization necessary to keep the light in its vertical orientation. The fixture itself usually comprises a metallic framework which holds a socket for a bulb which is surrounded by a translucent cylindraceous lens on which are usually mounted a series of frusto-confical light deflecting rings (louvers) which direct the light diffused through the lens toward the surrounding ground.

Prior art devices, such as those described above, are not easily "hidden" in the landscape architecture because of the nature of the structure of the lamp, because of the characteristic vertical profile and the downward sloping light deflecting rings mounted on the refractor housing (giving the impression of a miniature weather station or a lamp suitable for enduring a hurricane).

The prior art devices do not provide reflected light but rather a filtered light which is passed through a translucent refractor between the deflecting rings. Because most prior art lights utilize a steel or plastic spike which is driven into the ground to stabilize the device, the lights are unsuitable for rocky or concrete surfaces.

The structure of the prior art garden lamps is quite fragile in that the lamp itself tends to be somewhat slender and elongated with the refractor serving to also provide substantial structural support for the lamp itself. The lamp itself is often placed where landscaping maintenance equipment must operate and the lamp is subject to lens fracture and other structural damage if inadvertently struck by maintenance equipment.

SUMMARY OF THE INVENTION

The garden lamp of this invention comprises a natural stone body (preferably limestone) which has a shape selected by a landscape designer. The stone body is sliced, usually with a diamond saw, to produce two stone pieces to produce a body and a cap. The body of the stone is bored to produce a bore completely passing through the body in a direction (usually) perpendicular to the surface of the flat surface produced by the saw cut.

Next, the original bore is subjected to a counter boring operation to provide an enlarged bore which extends in a co-axial direction a predetermined distance below the flat surface formed by the saw cut.

A weather resistant lighting fixture is installed in the bore of the body portion and the recess formed by the counter bore forms a ledge to support an inserted lighting device so as to accurately locate the lighting device a predetermined distance below the flat surface of the stone body.

Next, a series of pedestals (reasonably slim) of a stainless steel (preferably) are inserted into holes drilled into the flat surface of the body at preselected locations.

Similar recesses are formed in the matching stone cap and the stone cap is placed on the upwardly projecting pedestals to provide a cover for the lamp installed in the base.

The resulting lamp appears to be a stone having an evenly spaced cap and body where the cap appears to "float" above the body. This robust lamp is usually powered from a low voltage source and the lamp may be placed in a garden, a pathway or in a patio surrounding and when unlit will pass as a contemporary stone decoration but when lit during darkness produces a soft diffused light, which in this instance, has been conditioned by the reflection from the stone faces surrounding the lighting fixture. The lighting fixture is preferably depressed in the stone body sufficiently to avoid detection by the human eye.

In an alternate form, the lamp may utilize a transparent plastic cylinder to support the cap above the body.

PERTINENT PRIOR ART

U.S. Pat. No. 4,716,508 Dec. 29, 1987

A frusto-conical pedestal is provided with a horizontally extending fluorescent bulb in a luminaire assembly which arranged to produce a "slit" to permit reflected and directly emitted light from the contained fluorescent lamp to escape. This lamp features a conical concrete base which may be supplied with an auxiliary concrete collar to improve stability. The refractor-lens-reflector assembly is quite fragile and is subject to damage by landscaping maintenance equipment which may be operated in the vicinity of this lighting device.

U.S. Pat. No. 5,203,627 Apr. 20, 1993

U.S. Patent Des 347,485 May 31, 1994

This garden lamp is formed by a pair of ceramic shells which are mated together to form a hollow structure, the outward appearance of which resembles a clam shell. This lamp is intended to "blend in" with other garden decorations such as "grey stones" thus the exterior ceramic surface is treated to match adjacent stones in the garden.

This lighting device employs a lens system and an integral reflector-bulb assembly which may be moved toward and away from the lens to change the lighting effect. This garden lamp exposes the bulb and reflector to an observer at the "front" of the lamp.

U.S. Pat. No. 4,996,636 Feb. 26, 1991

U.S. Pat. No. 5,398,180 Mar. 14, 1995

U.S. Pat. No. 5,692,828 Dec. 2, 1997

These are typical garden lamps presently found in great quantities in the U.S.A. Typically, the garden lamps of these patents show an elongated vertically extending housing which is attached to a stake which may be pushed into the ground to keep the lamp firmly located in its desired location. The housing serves as a mount for the semi transparent lens which serves to carry one or more frusto-conical louvers (for aesthetic purposes).

These garden lamps are quite functional in that they do provide a circle of light which tends to be deflected downwardly by the downwardly sloping louvers surrounding the lens, but the presence of these fixtures is not easy to camouflage in modern landscape settings.

DESCRIPTION OF THE PREFERRED EMBODIMENT

Figure 1:
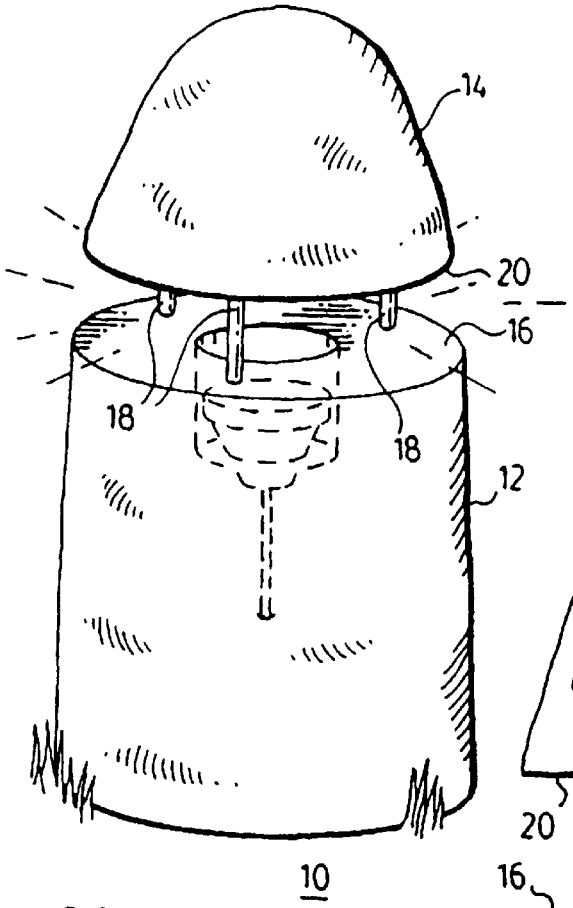
FIG. 1 is a perspective view of the garden lamp of this invention.

Referring now to FIG. 1, a garden lamp 10 is illustrated. The lamp 10 is comprised of two cooperating parts; a base 12 and a matching cap 14. The cap 14 is supported by the pedestals 18 to be at a predetermined distance above the top surface 16 of base 12.

Base 12 is provided with a bore 22, which in this instance, passes completely through base 12. A counter bore is provided in the base 12 extending from the top surface 16 downwardly a predetermined distance to provide a housing for lamp assembly 26. Lamp assembly comprises a weatherproof housing 28 which holds a lens 30, a bulb 32 and a reflector 34 securely within the housing. A pair of insulated wire conductors 36 and 38 pass through the bore 22 to provide energy for bulb 32.

In practice, the lamp is preferably made from a single stone or rock with cap 14 being produced by a single saw art of the original stone comprising the cap 14 and base 12.

The preferred rock for this purpose is a natural limestone which has been shaped by the action of water currents and waves over the past few thousand years. These rocks have found widespread use in gardens because of the shapes produced by the continuous action of the water in which they have been immersed. The natural limestone rock is sliced in two to produce a cap 14 and a base 12. The base is then subjected to a core drilling operation to produce bore 22 and counter bore 24. Shoulder 35 results and provides a resting surface 35 for lamp assembly 28.

Usually three blind holes are drilled in surface 16 for pedestals 18. Three similar holes are provided in surface 20 of cap 14. Pedestals 18 are solidly mounted in the blind holes provided in base 12 by means of epoxy resin which, when cured, fully anchors the pedestals 18 in the blind holes.

The corresponding recesses provided in the cap 14 are provided to have a clearance fit to permit easy removal of cap 14 for the future maintenance of lighting assembly 28.

The lighting assembly 28 is preferably located in body 12 in a countersunk fashion in counter bore 24 to a depth where the view of the light itself is obstructed by the presence of cap 14. This means that only light reflected from surface 20 (and surface 16) is emitted by this rock lamp 10. If the rock is natural limestone, the light reflected from surfaces 16 and 20 is a mellow yellow light, the spectrum of which is determined by the light absorptive qualities of the surfaces 16 and 20.

The sawed surface of the natural limestone provides an excellent reflector surface for lamp 10 and the slot 39 between the cap 14 and base 12 can be made small enough to act as a diffuser so as to accentuate the aesthetic qualities of the lamp.

Figure 2:
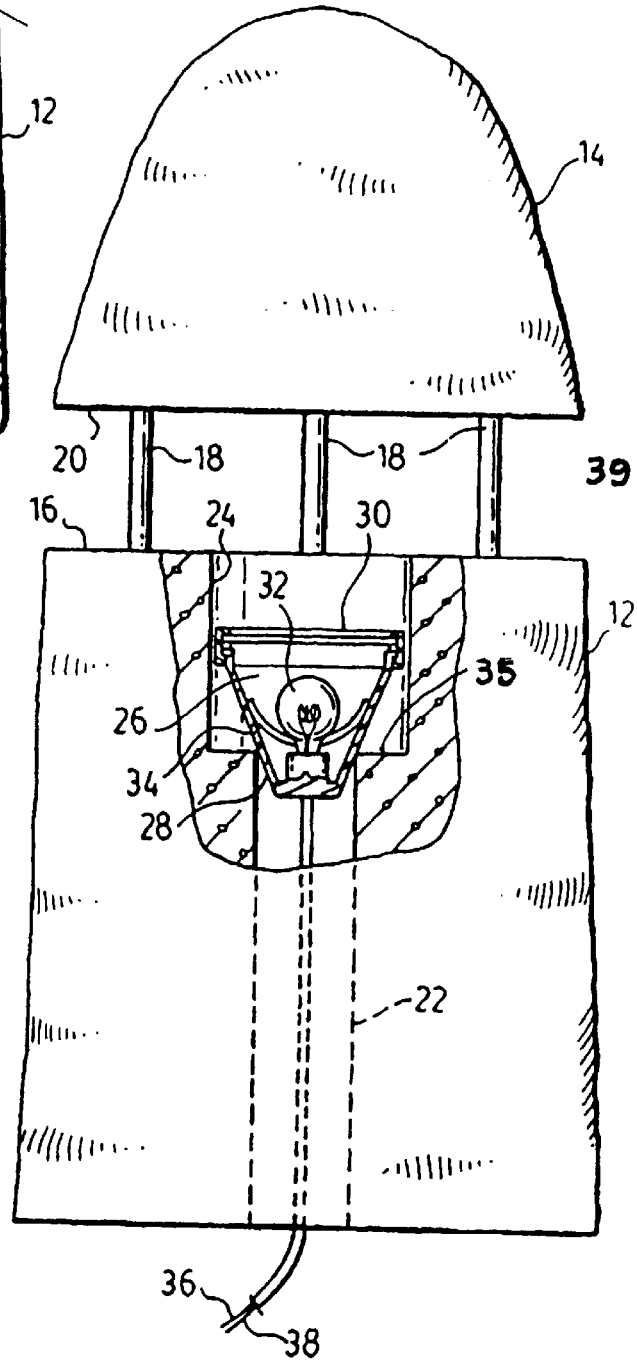
FIG. 2 is a plan view of the lamp of FIG. 1 having a partial section to show the mounted lamp assembly.
Figure 3:
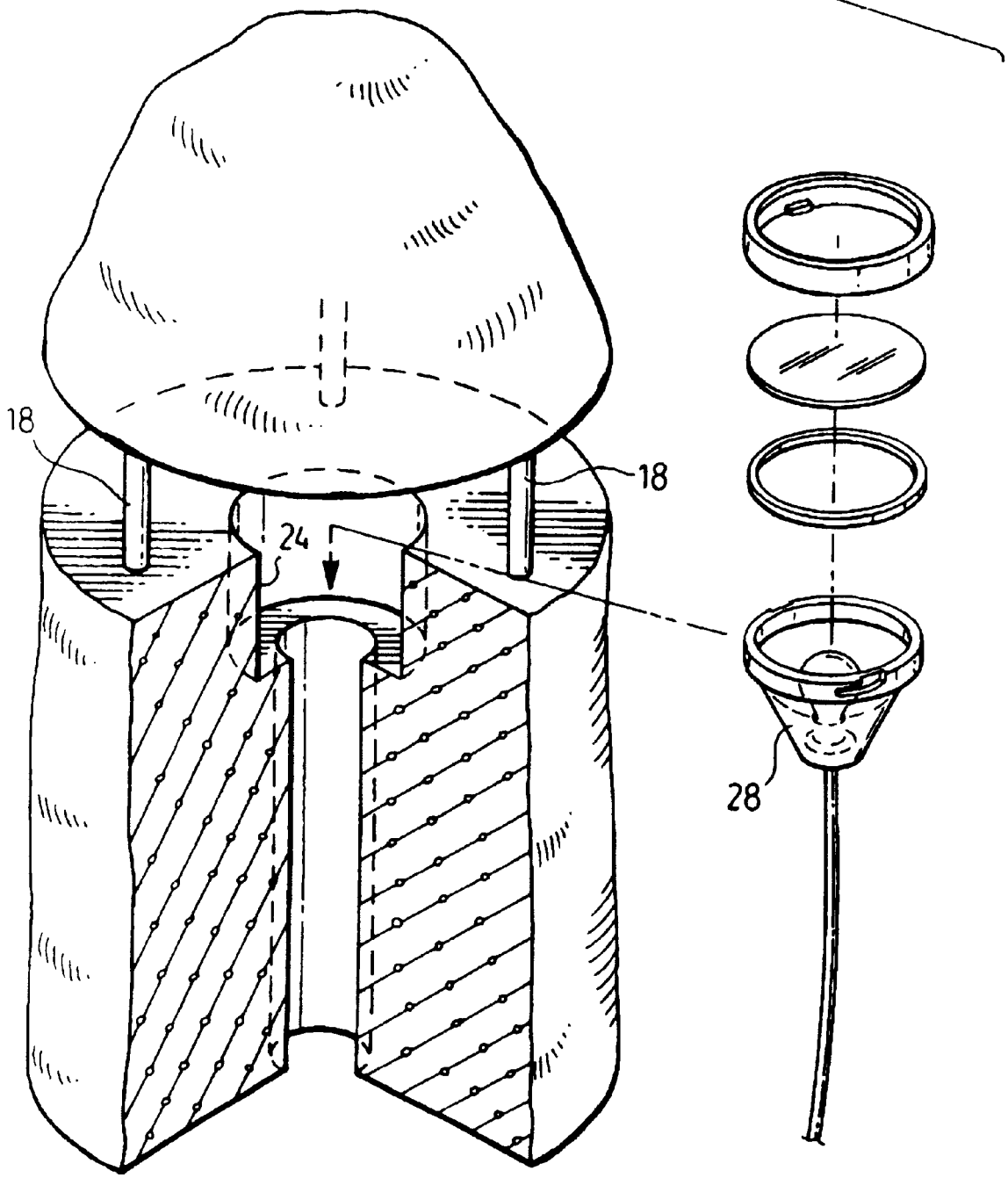
FIG. 3 is a top view of the lamp of FIG. 1.
Figure 4:
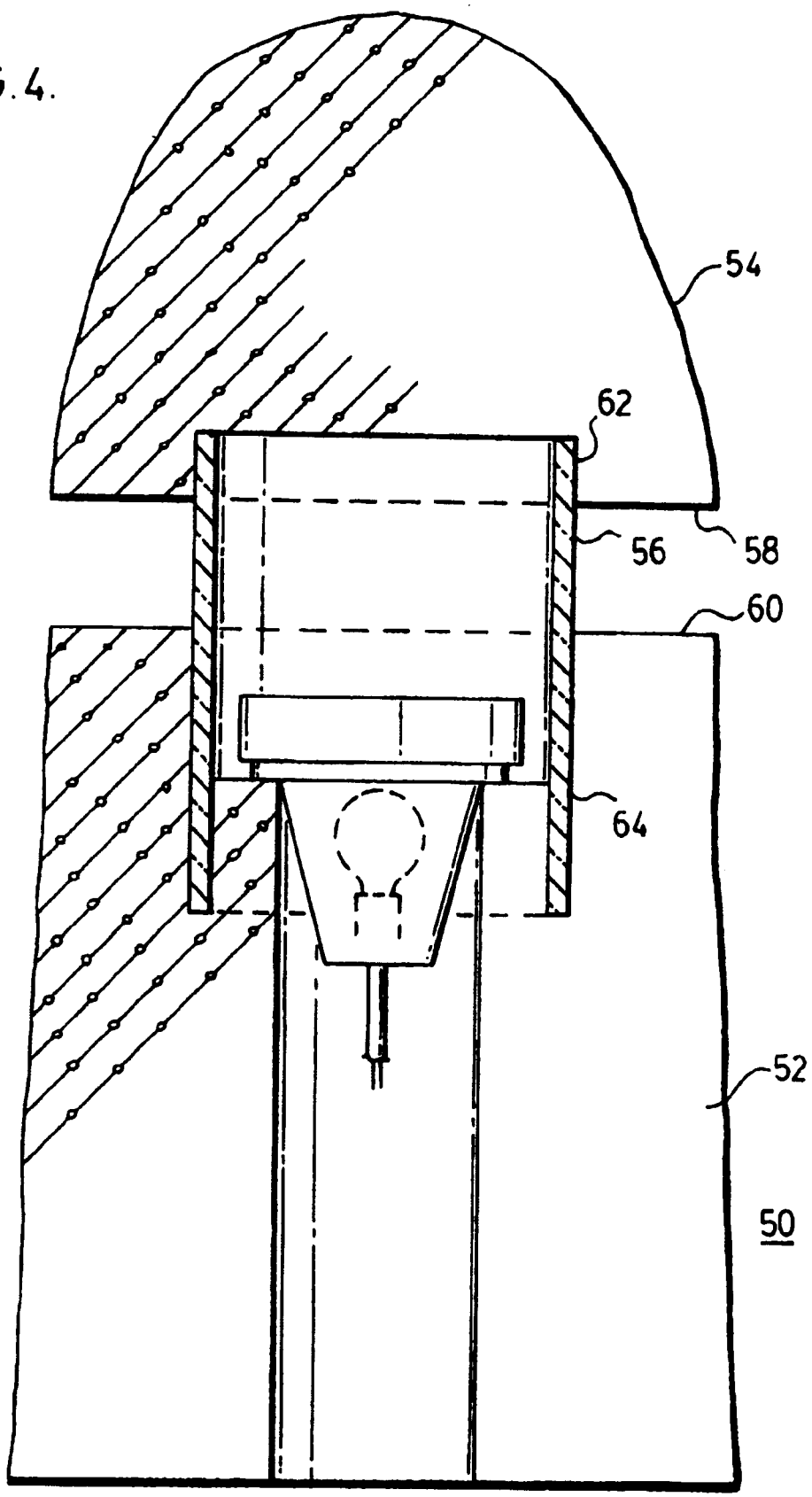
FIG. 4 is an alternate form of this invention using a transparent plastic lens to support the cap.

FIG. 4 shows an alternate form of the lamp shown in FIGS. 1, 2 and 3. Lamp 50 comprises a body 52 and cap 54 separated by a (preferably) transparent plastic cylinder 56. Cylinder 56 is located in two cylindraceous rings 62 and 64 in cap 54 and body 52 respectively. These rings are easily provided by core drilling the cap 54 and body 52 from surfaces 58 and 60 respectively.

The lamp assembly is inserted into body 52 as previously. In this instance, the cap 54 appears to have no visible support from base 52 whatsoever.

The material which comprises the cylinder 56 preferably is a tough transparent polycarate material available from the General Electric Company wider trademark "Lucite".

Limestone is a preferred substance for these lamps for many reasons:

Natural limestone is very abundant in certain areas of this continent and landscape artists have long realized that naturally formed limestone rocks have shapes that have endlessly fascinated mankind. These rocks are conveniently available and tend to be inexpensive.

The sawed rock surfaces, when located in close proximity, produce an emitted light which is particularly pleasing to the eye.

Limestone is relatively easy to cut and bore when compared to the varieties of granite or other hard rocks found freely in nature.

Because landscape decorators have consistently used natural limestone rocks as decoration pieces in gardens, patios etc., the lamp of this invention fits into most schemes in an almost invisible maimer.

It will be obvious, to those skilled in the art, that there may be instances where granite rock lamps may be specified by the landscape design artist. A lamp may be similarly fabricated from a granite rock but the time and cost is substantially greater.

The bottom surface may be flattened if, for instance, it is desired to seat the lamp on a flat surface.

The supply wires may be supplied from a second bore orthogonal to the first bore (22) so that the electrical supply may be made from the side of the base instead of the bottom.

The aesthetic appeal of the lamp cannot be over emphasized. The lamp chosen for most lamps having an exterior diameter of about 1–1½ feet at the lighting slot would preferably utilize a low voltage high intensity lamp of about 50 watts to produce the desired level of reflection and diffusion of the light emitted from the bulb. It has been found that the lamp is most aesthetically pleasing if the lighting assembly 28 is obscured by cap 14.

While the invention has been described as utilizing a transparent lens 30 or a transparent cylinder 56, it will be understood that these light transmitting devices may be substituted with coloured transparent devices to alter the colour of the light reflected from the rock lamp. For instance, it may be desirable to mark the exits from a public garden with lighting devices whose major component of emitted light is red.

While other configurations of this lamp will be readily apparent to those skilled in the art, applicant prefers to limit the ambit of protection for this device by the scope of the following claims.

I claim:

1. A reflector-diffuser for a rock lamp comprising:

a pair of opposing substantially flat rock faces spaced apart in a predetermined spaced substantially parallel relationship, said rock faces being maintained in said spaced relationship by suitable support means, one of said faces being formed on a rock body housing illumination means, said illumination means being countersunk into said rock body at a predetermined distance below said surface of said one of said faces.

2. A reflector-diffuser as claimed in claim 1 wherein a second flat surface of said pair is formed in a matching rock cap formed of rock similar to said rock body, and wherein said cap is mounted vertically above said rock body on said support means.

3. A reflector diffuser for a rock lamp as claimed in claim 1 wherein said support means comprises at least three pedestals.

4. A reflector diffuser as claimed in claim 1 in which said support means comprises a light transmissive cylinder.

5. A garden lamp comprising:

a pair of rock pieces formed by a sawing operation wherein a naturally occurring stone is sawn in two so that one of the resulting rock pieces forms a lamp cap and the other rock piece becomes a lamp body, said pieces each having a flat surface formed by said sawing operation, said garden lamp housing a lighting device housed in recess countersunk from said flat surface in said body for producing illumination, said lamp having said rock cap mounted a predetermined distance above the flat surface of said body for intercepting and reflecting the illumination produced by said lighting device.

6. A method of making a garden lamp from a monolithic rock comprising:

providing a suitable rock for said garden lamp, sawing said rock in two to form first and second pieces, said first piece forming a housing and said second piece forming a cap, each piece having a flat sawn surface, drilling a bore in said housing extending in a direction perpendicular to said flat surface at substantially the center of said flat surface, mounting a lighting device in said bore, placing said first piece on a suitable base support so that said flat surface is facing upwardly and is substantially horizontal, providing suitable cap support means on said flat surface of said first piece to support said cap, placing said cap on said cap support means so that said flat surfaces are in substantially predetermined spaced parallel relationship.

7. A method as described in claim 6 wherein said cap support means comprises at least three pedestals.

8. A method as described in claim 6 wherein said cap support means comprises a hollow light transmissive cylinder.

9. A reflector diffuser as claimed in claim 2 wherein said support means comprises at least three pedestals.

10. A reflector diffuser as claimed in claim 2 wherein said support means comprises a light transmissive cylinder.

* * * * *